United States Patent [19]

Kuhlman et al.

[11] Patent Number: 4,688,507

[45] Date of Patent: Aug. 25, 1987

[54] APPARATUS FOR COUPLING TUGBOATS TO BARGES

[75] Inventors: Clare J. Kuhlman, Kansas City, Mo.; Robert P. Hill, Boston, Mass.

[73] Assignee: Intercontinental Engineering-Manufacturing Corporation, Kansas City, Mo.

[21] Appl. No.: 752,059

[22] Filed: Jul. 5, 1985

[51] Int. Cl.[4] ..... B63B 21/58

[52] U.S. Cl. ..... 114/249

[58] Field of Search ..... 114/242, 248, 249–250

[56] References Cited

U.S. PATENT DOCUMENTS

| | | | |
|---|---|---|---|
| 3,512,495 | 5/1970 | Fletcher | 114/248 |
| 3,827,407 | 8/1974 | Stratienko et al. | 114/249 |
| 3,837,316 | 9/1974 | Stratienko et al. | 114/249 |
| 3,844,245 | 10/1974 | Yamaguchi | 114/248 |
| 3,910,219 | 10/1975 | Ono et al. | 114/249 |
| 3,935,831 | 2/1976 | Yamaguchi | 114/248 |

*Primary Examiner*—Joseph F. Peters, Jr.
*Assistant Examiner*—Jesûs D. Sotelo
*Attorney, Agent, or Firm*—Kokjer, Kircher, Bradley, Wharton, Bowman & Johnson

[57] ABSTRACT

Apparatus for coupling a tug boat to a barge having a notch in its stern. Coupling units mounted on the opposite sides of the tug have extensible and retractable rams which carry toothed heads into and out of toothed channels on the opposite sides of the stern notch. Each ram is extended and retracted by an actuator screw driven by low and high speed electric motors. A lock nut can be tightened on the screw to prevent it from rotating relative to the ram. The rams are controlled from a control panel located in the wheel house of the tug.

29 Claims, 11 Drawing Figures

APPARATUS FOR COUPLING TUGBOATS TO BARGES

BACKGROUND OF THE INVENTION

This invention relates generally to the field of water craft and more particularly to a coupling device of the type which serves to couple a tugboat to a barge.

Barges have long been used to transport various types of cargo in oceans, rivers, lakes and harbors. The barges are often maneuvered by tugboats which can be connected either to tow or to push the barges. If the barge is to be pushed, it is convenient to provide it with a well or notch in the stern for receiving the tug. Various arrangements have been proposed for coupling the tugboat to the barge, as exemplified by U.S. Pat. No. 3,512,495 to Fletcher and U.S. Pat. Nos. 3,844,245 and 3,935,831 to Yamaguchi.

The coupling devices shown in these patents have been less than satisfactory in a number of respects. All rely on hydraulic power to extend coupling pins into cavities or channels in the barge and to hold the pins in place. The hydraulic components are not always able to withstand the extremely large forces that are encountered, particularly in heavy seas. As a result, there is a lack in the safety and reliability of existing coupling devices. If the coupler should release, the hulls of the vessels can come into forceful contact and create serious damage and possible injury to crew-men. The relatively weak overall construction of existing units can also result in failure, especially after the coupler has been in service for an extended period of time.

In the event of a failure in the hydraulic power system, hydraulically operated coupling devices are virtually useless. It is also difficult to initially couple the tugboat with the barge because of the difficulty that is involved in precisely aligning the pins with the cavities or channels which receive them. Equally significant, the loads which are applied to the coupling device are not well distributed among the load carrying components and can be applied unevenly such that one pin and cylinder receives a disproportionate share of the load, thereby increasing the likelihood of failure. The entry of sea water and other contaminants into the operating components of existing coupling devices has created additional problems.

SUMMARY OF THE INVENTION

The present invention provides an improved coupling device which avoids the foregoing problems and operates in a safe and effective manner to couple a tugboat to a barge.

It is an important object of the invention to provide a heavy duty mechanical coupling device which has a sufficiently rugged construction to withstand the considerable forces that are encountered in service. The heavy duty construction of the coupler maintains a positive and secure tug to barge connection under even the worst conditions, thereby eliminating the possibility of hull contact and other dangerous situations.

Another object of the invention is to provide a coupling device which can be easily and accurately engaged with the barge under all draft conditions without the necessity of utilizing ballast on either the tug or barge.

Yet another object of the invention is to provide a coupling device which is operated electrically under normal conditions but which is equipped with both pneumatic and manual backup systems that can be used in the event of a power failure or in other emergency conditions where the electric drive motors are disabled.

A further object of the invention is to provide a coupling device having an extensible and retractable ram that is mechanically locked in place in a secure manner. Unlike prior art devices which use hydraulic cylinders to extend the coupling pins and retain them in the extended positions, the coupling unit of the present invention incorporates a large actuator screw which acts to extend and retract the ram. When the ram has been fully extended and is properly positioned in the receiving channel in the barge, a lock nut is activated to mechanically lock the ram and screw together to hold the position of the ram in the relation to the screw.

An additional object of the invention is to provide, in a coupling device of the character described, a control system which permits all components to be fully controlled and monitored from the wheel house of the tug.

A still further object of the invention is to provide a coupling device of the character described which is simple and economical to construct and install and which is protected against water and other contamination.

In accordance with the invention, the opposite sides of the tug are each equipped with a coupling unit having an extensible and retractable ram. The interface heads of the rams can be extended into vertical channels (connecting ladder) installed on the opposite sides of the stern notch of the barge. The channels have teeth on their fore and aft walls which mate with teeth on the heads of the rams. The head is a solid steel casting which has multiple teeth on its opposite sides. The interface heads are positioned on a spherical support on the ram assembly and guided by pins which allow each head to pivot in limited fashion about a vertical axis formed by the guide pins and also about a horizontal axis oriented perpendicular to the ram axis. This limited flexibility of the heads allows the teeth to properly mate with the teeth of the channels during extension of the rams. At the same time, the loads which are applied to the coupling units in service are distributed among the teeth on the heads and are transmitted to the heavy duty steel spherical support on the assemblies.

Each ram is axially extended and retracted by a large actuator screw which turns in an internally threaded ring carried on the ram. Low and high speed electric drive motors turn the screws through reduction gearing. At higher speeds, a clutch disconnects the low speed motor to protect it from over speed. Emergency air motors can be used to drive the actuator screw if the electric motors are disabled due to a power loss or other problem. A manual ratchet handle provides an additional backup drive system for each ram. The coupling arrangement permits the tug and barge to move only in relative pitch movement about the axis of the rams. Pneumatic cylinders tighten a lock nut on the actuator screw to lock it against relative motion caused by relative pitch motion of the vessels.

The electrical and pneumatic components are controlled and monitored from a control panel located in the wheel house of the tug. Switches on the control panel serve to extend, retract and align the rams and to control the lock nuts and the backup air motors of both units. An automatic system is provided to assure that both rams are equally loaded and equally extended. The control system includes a load cell which monitors the load of the rams and controls the system in the event of an overloaded condition.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
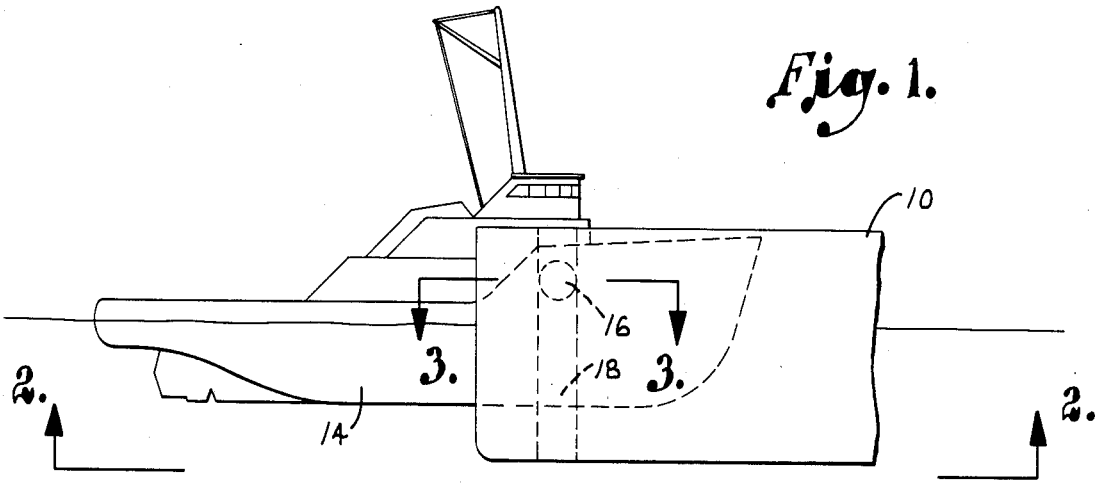
FIG. 1 is a side elevational view showing a tug coupled to a barge by the coupling apparatus of the present invention, with the barge being shown only fragmentarily.
Figure 2:
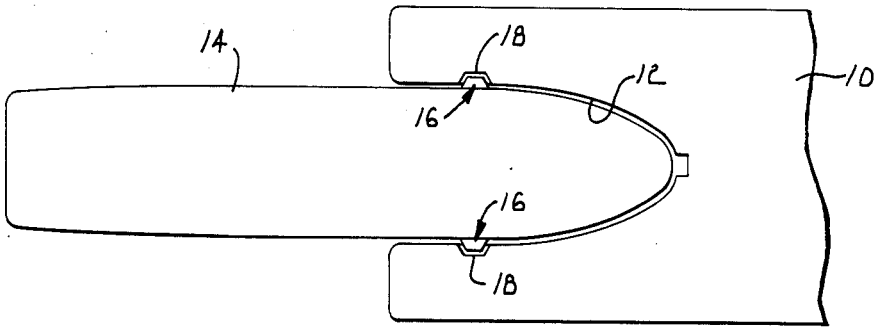
FIG. 2 is a bottom plan view taken generally along line 2—2 of FIG. 1 in the direction of the arrows.

Referring now to the drawings in more detail and initially to FIGS. 1 and 2, numeral 10 designates a barge having a notch or well 12 in its stern for receiving the bow of a tugboat 14 used to push the barge. In accordance with the present invention, each side of the tug 14 is equipped with a coupling unit generally designated by numeral 16. In order to couple the tug 14 with barge 10, the coupling units 16 cooperate with vertical channels 18 located on the opposite sides of the stern notch 12. The channels 18 face the center line of the barge and can have virtually any desired length. Typically, the channels have a length of between 20 and 35 feet, depending upon the particular barge on which they are installed.

Figure 3:
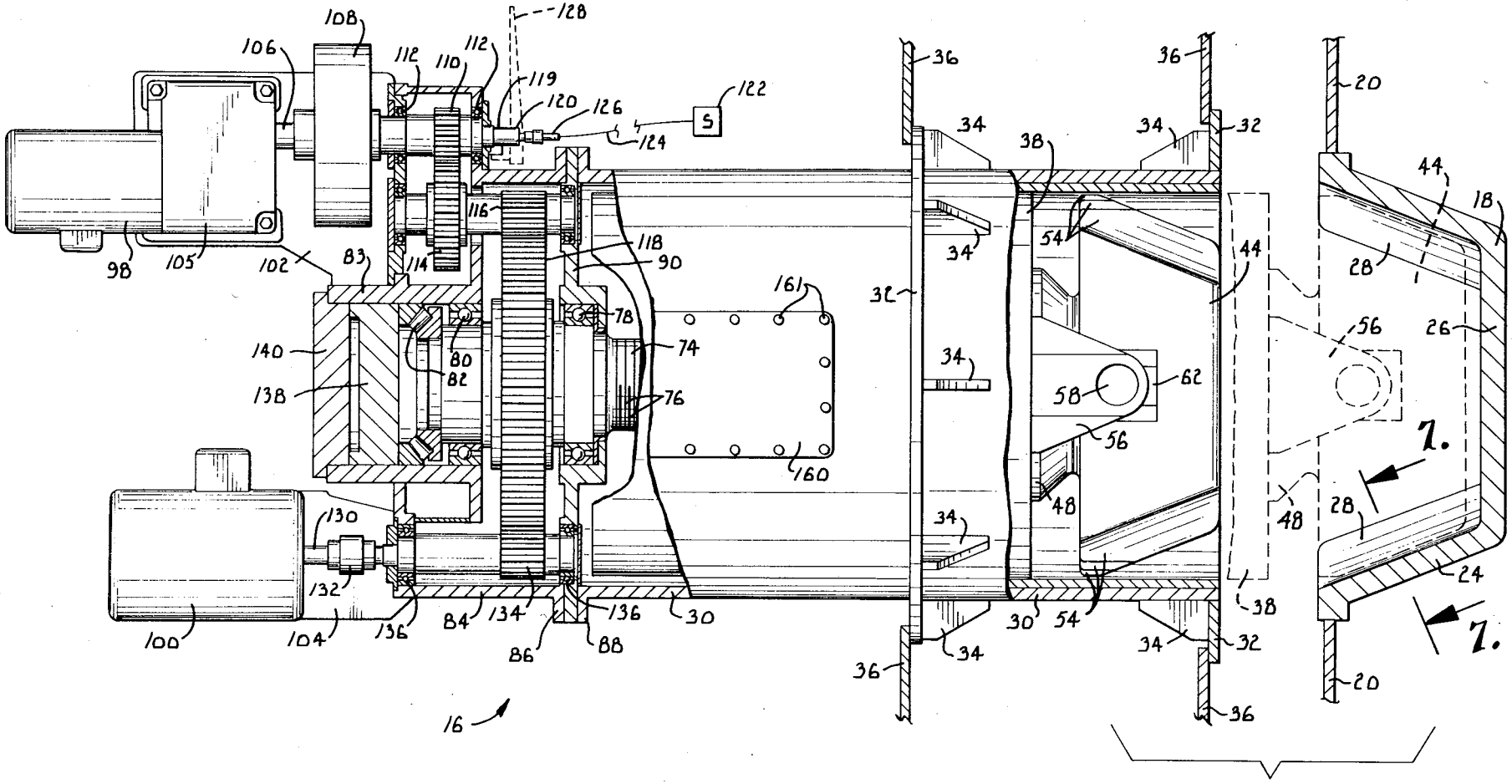
FIG. 3 is a fragmentary sectional view on a enlarged scale taken generally along line 3—3 of FIG. 1 in the direction of the arrows and showing one of the coupling units, with portions broken away for purposes of illustration and the broken lines illustrating the extended position of the ram of the coupling unit.
Figure 7:
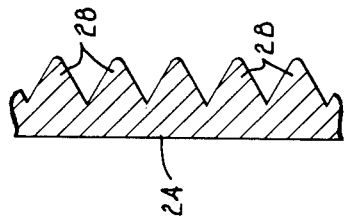
FIG. 7 is a fragmentary sectional view taken generally along line 7—7 of FIG. 3 in the direction of the arrows.

Referring additionally to FIG. 3, each channel 18 is a cast member which is recessed into the hull 20 surrounding the stern notch 12. Each channel 18 has fore and aft walls 22 and 24 which converge slightly as they extend inwardly. A flat base 26 connects the walls 22 and 24. Each wall 22 and 24 is provided with a series of teeth 28 which are spaced uniformly apart along the entire length of the channel. As best shown in FIG. 7, the teeth 28 are equal in size and are uniformly spaced to balance the forces that are applied and minimize multiple angle planes of contact.

The coupling units 16 which are installed on the opposite sides of the tug 14 are identical to one another. Each coupling unit 16 includes a cylindrical housing 30 formed of rolled steel plate and having a wall thickness sized to provide considerable strength and rigidity. A pair of circular mounting flanges 32 are welded or otherwise secured to the outer surface of housing 30 and are reinforced by gusset plates 34. The flanges 32 are welded or otherwise suitably connected in rigid fashion with the hull 36 of the tug 14. The flanges 32 can be suitably spaced to conform with the hull configuration. In this manner, each housing 30 is mounted on the side of tug 14 with the open end of the housing facing outwardly.

Each housing 30 receives a ram 38 which can be extended out of and retracted into the housing. The two rams 38 are in axial alignment with one another. Each ram 38 has a cylindrical wall which is preferably formed of steel. The ram 38 is carried in a cylindrical bushing 40 which is fitted in the outer end portion of housing 30. The bushing provides a large bearing surface and permits the ram to extend and retract as necessary. The bushing 40 has a cavity which receives a packing arrangement 42 formed by a plurality of packing rings. The packing contacts housing 30 and ram 38 to prevent the entry of sea water and other contaminants.

Figure 4:
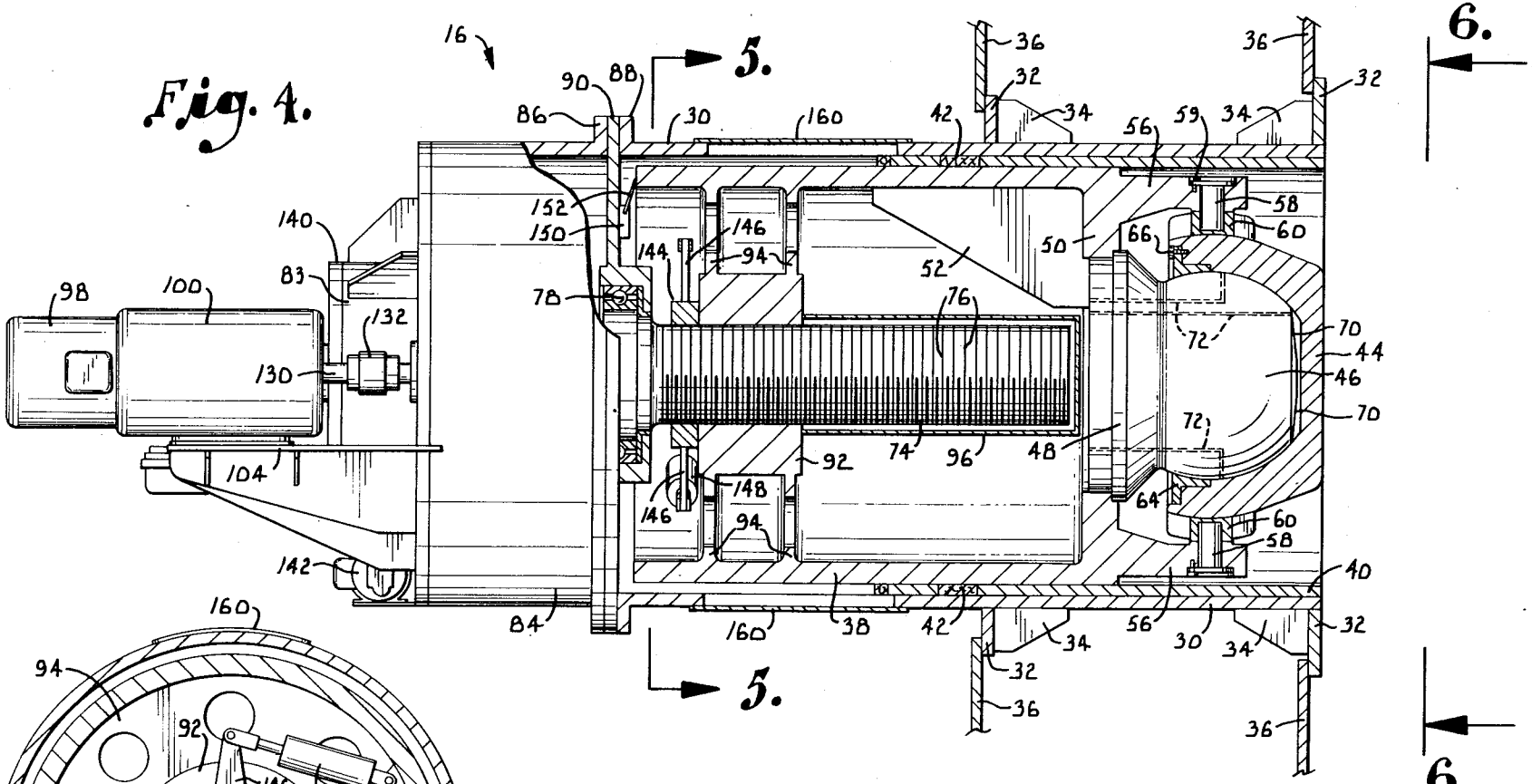
FIG. 4 is a side elevational view, partially in section, of the coupling unit shown in FIG. 3.

As best shown in FIGS. 3 and 4, the leading or outer end of each ram 38 carries a head which is formed by a cast component 44 mounted on a solid steel ball 46. Ball 46 has a neck portion 48 which is welded or otherwise secured to an annular flange 50 projecting inwardly from the wall of ram 38. A plurality of gusset plates 52 serve to reinforce the ram 38 and its connection with the head.

Figure 6:
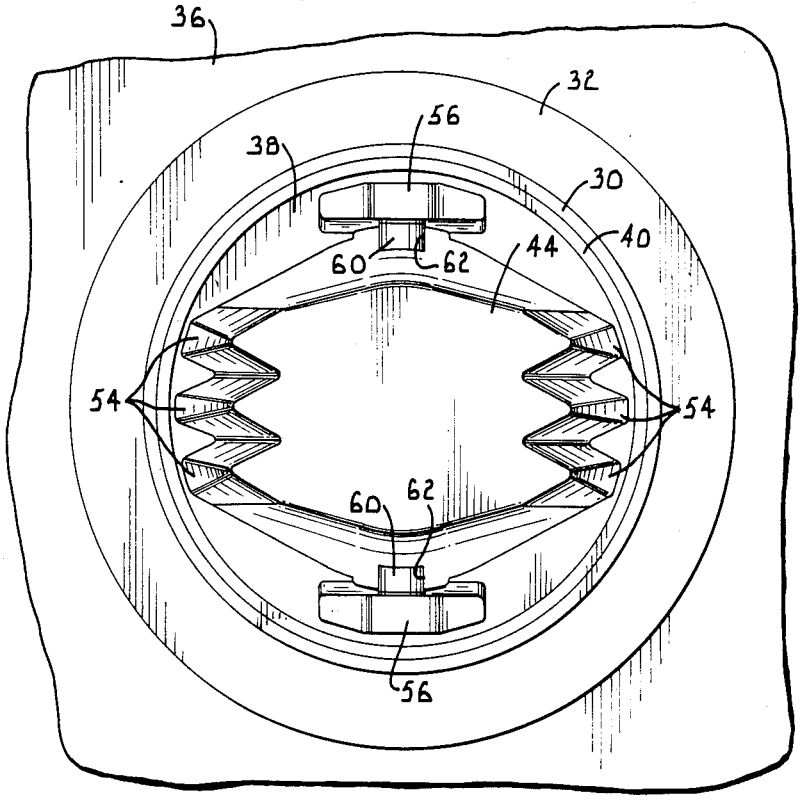
FIG. 6 is a fragmentary end elevational view taken generally along line 6—6 of FIG. 4 in the direction of the arrows.

The opposite sides of head 44 are tapered to conform with the taper of the fore and aft walls 22 and 24 of channel 18. The tapered sides of the head are each provided with a plurality of teeth 54 having the same size and spacing as the teeth 28 on the walls of the channel. When the head of each ram is extended into the channel, teeth 54 mate with teeth 28 to prevent the heads of the rams from moving vertically within the channels. As shown best in FIG. 6, the opposite sides of head 44 are each provided with three teeth, and the forces applied to the heads of the rams are distributed relatively equally among the teeth.

Head 44 is mounted on ball 46 for limited pivotal movement about mutually perpendicular axes. A pair of ears 56 project outwardly from flange 50 and receive axially aligned guide pins 58 which are secured to the ears by screws 59. The guide pins 58 project inwardly from ears 56 and are received in bushings 60. The bushings 60 are in turn closely received in slots 62 which are formed in the top and bottom portions of the head 44 and which are generally parallel to the ram axis. A split retainer ring 64 retains head 44 on ball 46 and is secured to the head by screws 66.

The guide pins 58 establish a vertical axis about which head 44 can pivot in limited fashion on ball 46. The inside surface of head 44 contacts beveled surfaces 70 on the front face of ball 46 to limit the pivotal movement of the head in both directions about pins 58. The fit of bushings 60 in slots 62 permits head 44 to similarly pivot in limited fashion about a horizontal axis. The front face of ball 46 is provided with beveled surfaces 70 which limit the extent to which head 44 can pivot on the ball about the horizontal pivot axis. Both the horizontal and vertical pivot axes for the head pass through the center of ball 46. The close fit of bushings 60 in slots 62 assures that the head cannot rotate on the ball about an axis coincident with the longitudinal axis of ram 38. Consequently, rotational movement of ram 38 about its axis is transferred by guide pins 58 to the head 44. Lubrication passages 72 extend through ball 46 to provide lubrication.

Ram 38 is extended and retracted by a large actuator shaft or screw 74 having external threads 76. Screw 74 extends along the axis of ram 38 and is supported for rotation by a pair of roller bearings 78 and 80 and by a large spherical roller thrust bearing 82 which receives the end of the actuator screw. Bearings 80 and 82 are located adjacent to one another and are retained within a tail section 83 of a gear box 84. The gear box 84 is secured to housing 30 and essentially forms a continuation thereof. Circumferential flanges 86 and 88 are formed on the adjacent ends of the gear box 84 and housing 30, respectively. The outer edge of a retainer plate 90 is sandwiched between flanges 86 and 88. Plate 90 and flanges 86 and 88 are secured together by screws (not shown) or in any other suitable manner. Bearing 78 is mounted to the retainer plate 90.

With reference to FIG. 4 in particular, the actuator screw 74 extends through a ring 92 having internal threads that mate with the external threads 76 on the screw. Ring 92 is formed as an integral part of ram 38 and is connected with the wall of the ram by a pair of apertured plates 94. The actuator screw 74 is received within a steel tube 96 which is secured to and projects outwardly from the ring 92.

The actuator screw 74 is driven in normal operation by a pair of electric motors 98 and 100. Motor 98 is a low speed motor mounted on a platform 102 secured to gear box 84. The other motor 100 is a high speed motor mounted on another platform 104 secured to the gear box 84. Both motors are suitable for marine duty.

The low speed motor 98 drives a gear reducer 105 having an output shaft 106 which connects through a pneumatic clutch 108 with a pinion 110. The pinion 110 is supported by a pair of bearings 112 and drives a larger gear 114 which is mounted on the same shaft as another pinion 116. A large bull gear 118 is mounted on the actuator screw 74 and is driven by the pinion 116.

Also connected with pinion 110 are a pair of air motors 119 and 120 which are used for emergency extension and retraction of the ram. Line 124 leads to a fitting 126 which supplies air to the clutch. Also connected with pinion 110 is a ratchet handle 128 which is accessible so that it can be operated manually to rotate pinion 110 in either direction to thereby either extend or retract the ram 38. The handle 128 preferably connects with pinion 110 through a conventional ratchet mechanism.

The high speed motor 100 has an output shaft 130 which is connected by coupling 132 with a pinion 134. The pinion is supported for rotation by a pair of bearings 136. Pinion 134 mates with and drives the large bull gear 118 which is mounted on the actuator screw.

The thrust bearing 82 rests on a load cell 138 which senses the load that is applied to the actuator screw 74 during extension of ram 38. The load cell 138 is enclosed within the tail section 83 of the box 84 and engages a cover plate 140 of the tail section. The moving parts of the coupling unit 16 are provided with lubricant by a lubricant pump 142 (see FIG. 4).

Figure 5:
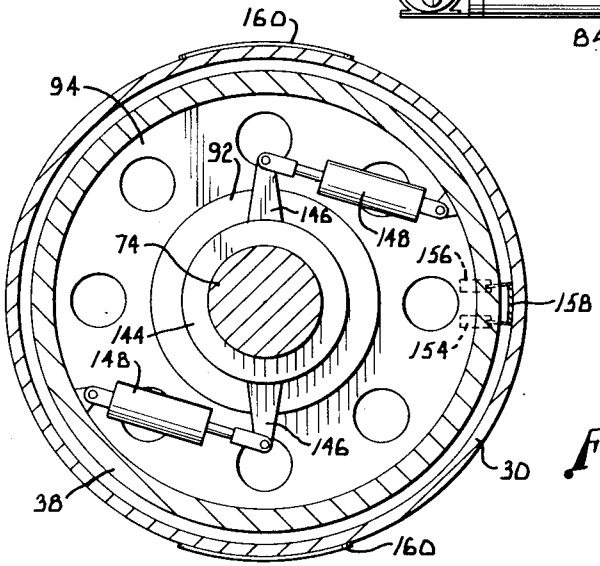
FIG. 5 is a sectional view taken generally along line 5—5 of FIG. 4 in the direction of the arrows.

An internally threaded lock nut 144 is threaded onto the actuator screw 74 at a location between bearing 78 and ring 92, as best shown in FIGS. 4 and 5. The lock nut 144 is provided with diametrically opposed lugs 146 which are pivotally connected with the rod ends of a pair of pneumatic cylinders 148. The cylinders 148 control the lock nut 144 and are pivotally connected at their base ends with the ram 38. When the cylinders are retracted, they tighten lock nut 144 against ring 92 and thereby serve to prevent the actuator screw 74 from rotating relative to the ring 92. When the pneumatic cylinders 148 are extended, they loosen the lock nut 144 by threading it away from ring 92. In this condition, the actuator screw 74 can be rotated relative to the ring 92.

When ram 38 is fully retracted, it trips a limit switch 150 having a projecting switch arm 152 engaged by the end of the ram in the fully retracted position. A similar limit switch (not shown) is tripped when ram 38 reaches its fully extended position. Another pair of limit switches 154 and 156 (see FIG. 5) are tripped when the ram 38 is rotated in one direction or the other beyond a limiting position relative to the housing 30. If ram 38 is rotated in a counterclockwise direction beyond the limiting position, a projecting switch arm of switch 154 is tripped by a small plate 158 mounted on housing 30. Conversely, if the ram is rotated in housing 30 beyond a limiting position in the clockwise direction, the switch arm of switch 156 is tripped by plate 158.

The housing 30 is provided with top and bottom access hatches which are normally covered by removable hatch covers 160 secured by screws 161. When the hatch covers 160 are removed, access is provided through the exposed hatches to the interior of housing 30 for inspection and/or servicing of the internal components.

Figure 8A:
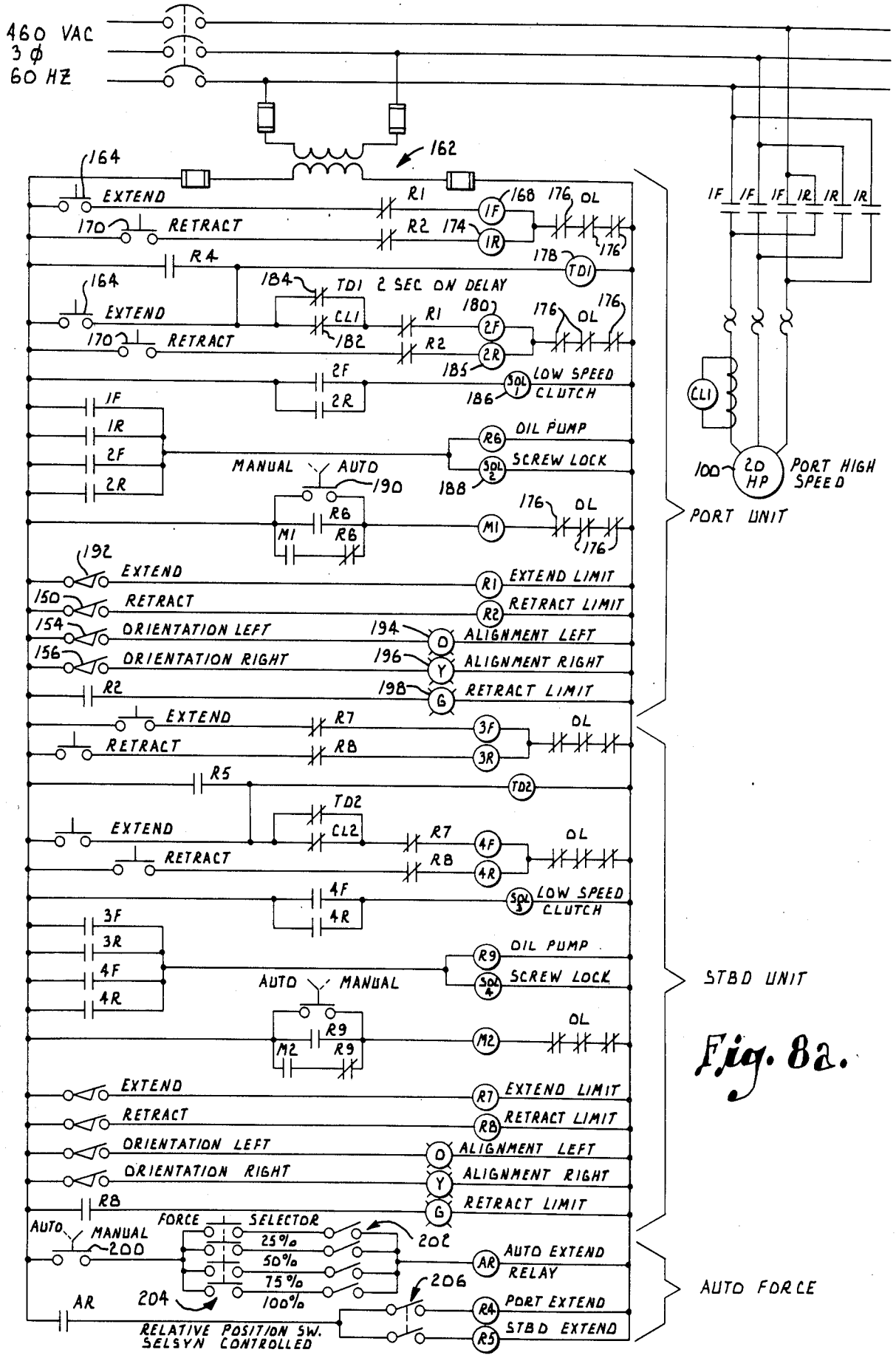
FIGS. 8*a* and 8*b* together form a schematic diagram of the electrical control system of the coupling apparatus.
Figure 8B:
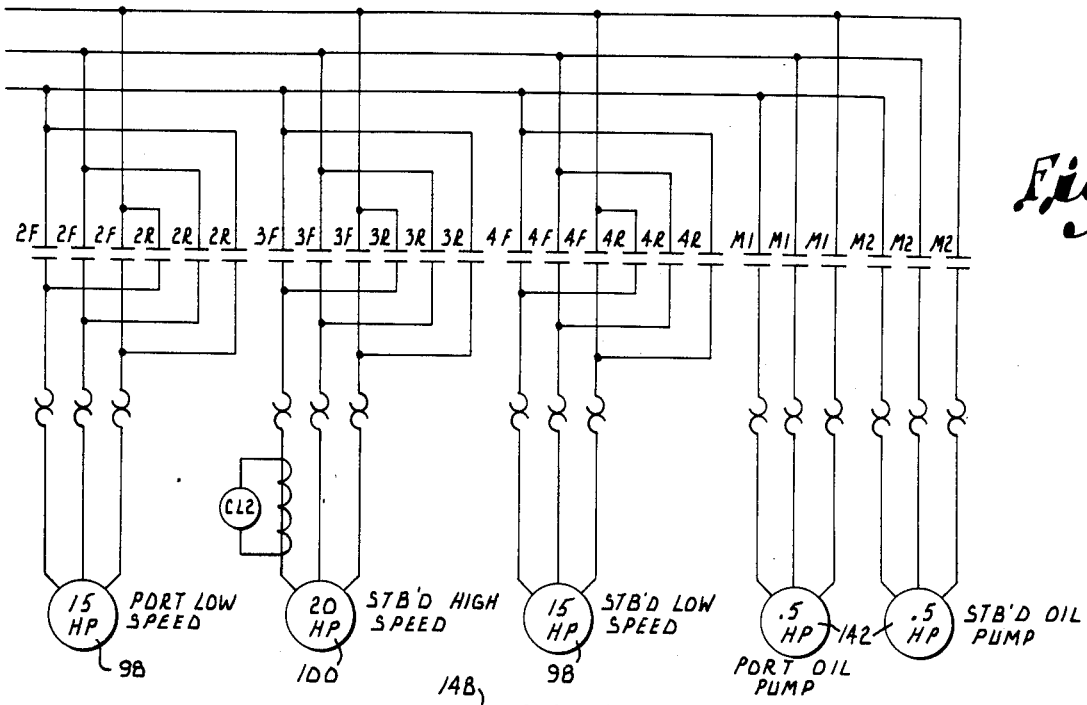

The control system which controls the operation of both the port and starboard coupling units 16 is illustrated schematically in FIGS. 8*a* and 8*b*. Electrical power from the tug 14 is available and supplied at 460 volts to the electric drive motors 98 and 100 of both coupling units and to the lubricant pumps 142 of both the port and starboard units. The three phase electrical power is supplied at 60 Hz. through relay contacts 1F and 1R to the high speed motor 100 of the port unit and through relay contacts 2F and 2R to the low speed motor 98 of the port unit. Similarly, the electrical power is available to the high speed motor 100 of the starboard unit through relay contacts 3F and 3R and to the low speed motor 98 of the starboard unit through relay contacts 4F and 4R. When the "F" relay contacts are closed, the corresponding motor is activated to drive the actuator screw 74 in a forward direction to extend the ram 38. Conversely, when the "R" relay contacts are closed, the corresponding motor is operated in a reverse direction to retract the ram.

A CL1 relay coil is connected with the circuit leading to the high speed motor 100 of the part coupling units. The CL1 coil is normally deenergized but is energized when the current to the high speed motor exceeds a predetermined level as sensed by the circuit of the CL1 coil. A CL2 relay coil operates similarly in the circuit of the high speed motor of the starboard unit.

The 460 volt three phase power is also applied through relay contacts M1 to the lubricant pump 142 of the port coupling unit and through relay contacts M2 to the pump 142 of the starboard unit.

The electric power is made available through a transformer 162 to the remaining components of the control system, all of which are located on the secondary side of the transformer. The control components for the port coupling unit 16 include an extend push button switch 164 which is located on a control panel in the wheel house of the tug and which closes when depressed. Arranged in parallel with switch 164 is a pair of normally closed R1 relay contacts and a 1F relay coil 168. Arranged in parallel with these components is a retract push button switch 170 which is wired in series with a set of normally closed R2 relay contacts 172 and a 1R relay coil 174. A series of normally closed OL overload contacts 176 are arranged in series with the extend switch 164 and retract switch 170. The extend switch 164 is also arranged in series with a TD1 relay coil 178 and, in a separate line, with R1 contacts and 92F relay coil 180. Connected in parallel with one another between the extend switch 164 and the R1 contacts are CL1 relay contacts 182 and TD1 relay contacts 184 controlled by coil 178. The CL1 and TD1 contacts are normally closed. Arranged in parallel with the extend switch 164 is a set of normally open R4 relay contacts which permit the extend switch to be bypassed in the automatic operational mode, as will be explained more fully.

The retract switch 170 is arranged in series with the R2 contacts and a 2R relay coil 185.

A solenoid 186 which controls the pneumatic clutch 108 of the port unit is controlled by the contacts of the 2F and 2R relay coils. The 2F and 2R contacts are arranged in parallel and are normally open so that the solenoid 186 is activated whenever either the 2F or 2R relay is energized.

Arranged in parallel are an oil pump relay coil R6 and a solenoid 188 which controls the pneumatic cylinders 148 for the lock nut 144. The R6 coil and the solenoid 188 are energized upon closing of any of 1F, 1R, 2F or 2F contacts for the low and high speed motors 98 and 100.

The M1 contacts which control the lubricant pumps 146 are controlled by an M1 relay coil which is arranged in series with the overload contacts 176. The M1 coil can be activated by depressing a push button switch 190 which is open in the automatic lubrication load. The M1 coil is also activated whenever the normally open R6 relay contacts are closed. Arranged in parallel with the normally open R6 contacts are a set of normally closed R6 contacts which are in series with normally open M1 contacts.

The extend limit relay coil R1 is arranged in series with an extend limit switch 192 which is normally open but which closed when ram 38 is extended to its limiting position. The retract limit relay R2 is similarly arranged in series with the retract limit switch 150 which closes when the ram is fully retracted. Limit switch 154 is arranged in series with an orange indicator light 194 which is located on the control panel to indicate that the ram is beyond the limiting position in one rotational direction. A yellow indicator light 196 is in series with the other limit switch 156 to provide a visual indication when the ram is rotated in the other direction beyond the limiting position. A green indicator light 198 is arranged in series with a set of R2 contacts which are normally open which close upon energization of the R2 coil due to closing of switch 150.

The control components for the starboard coupling unit 16 are indicated by the bracket designated "STDB UNIT" and are substantially identical to those previously described in connection with the port unit; therefore, a detailed description of the control components for the starboard unit is unnecessary.

The automatic force sensing system includes a push button switch 200 which is continuously closed in the automatic mode of operation. In the manual mode of operation, the switch is closed only when manually depressed. Switch 200 is arranged in series with a force selector which receives information from the load cells 138 of the port and starboard units to sense the differential in the loading between the two coupling units. The top switch in the switch bank 202 closes if the differential reaches 25%, the second switch closes if the differential reaches 50%, the third switch closes if the differential reaches 75%, and the fourth switch closes if the differential reaches 100%. The differential selected to effect operation of the automatic system can be selected by selecting one of four switches in switch bank 204. The force selector is in series with an auto extend relay AR.

The relay contacts AR for the auto extend relay AR are normally open but close when the AR relay is energized. A relative position switch 206 has two sets of contacts, one set of which is in series with the port extend relay R4 and the other of which is in series with the starboard extend relay R5. The relative position switch 206 is controlled by the differential selsyn system shown schematically in FIG. 10.

Figure 10:
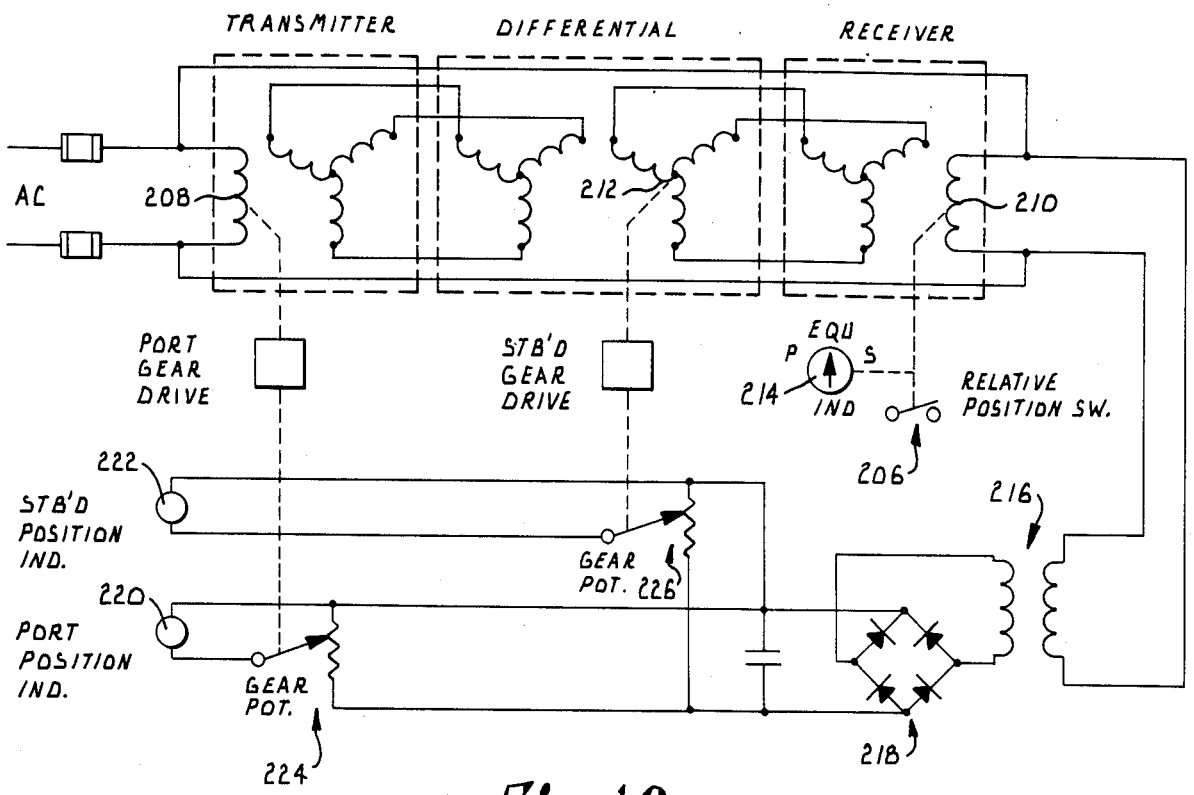
FIG. 10 is a schematic diagram of the differential selsyn system used to monitor and control the two coupling units.

Referring now to FIG. 10, the selsyn system includes a transmitter having a primary coil 208 carried on the gear drive system of the port coupling unit. Coil 208 is energized by AC power which is also applied to the primary coil 210 of the receiver of the selsyn system. The differential unit has its Y connected primary 212 carried on the gear drive system of the starboard coupling unit. Coil 210 is connected with the relative position switch 206 such that the position of switch 206 reflects the relative positions of the gear drive systems for the port and starboard units. Consequently, the position of the switch 206 reflects the differential, if any, in the extension of the portion and starboard rams. The primary coil 210 of the receiver is also connected with a dial indicator 214 on the control panel. The dial indicator thus provides a visual indication of the differential in the ram extension.

The AC power is applied through a transformer 216 having its secondary side connected with a diode bridge 218. The other side of the diode bridge connects with a port position indicator 220 and a starboard position indicator 222 which are arranged in parallel with one another. The circuit for the port position indicator includes a potentiometer 224 which is driven by the port gear drive system. Similarly, the circuit for the starboard position indicator 222 includes a potentiometer 226 which is driven by the starboard gear drive system. The position indicators 220 and 222 are located on the control panel and serve to provide a visual indication of the extent to which the port and starboard rams are extended.

Figure 9:
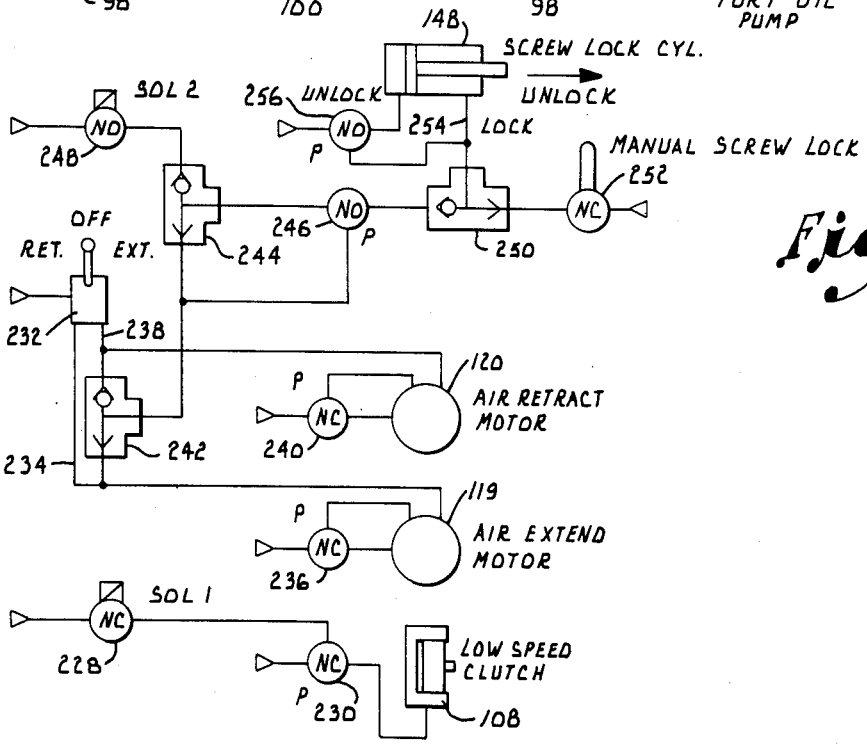
FIG. 9 is a schematic diagram of the pneumatic components included in the control system.

FIG. 9 schematically illustrates the control system for the pneumatic components of the port coupling unit, and it is to be understood that the starboard unit has a comparable pneumatic control system. The solenoid 186 controls a normally closed solenoid valve 228 which is connected between the pressurized air source and the pilot port of a pilot operated valve 230 which is normally closed but which is opened when its pilot port is pressurized. Valve 230 is connected between the air source and the low speed clutch 108. The clutch 108 is normally disengaged (when valve 230 is in its normally closed condition) but is engaged when valve 230 is open to supply the clutch with air.

The air motors 119 and 120 are controlled by a manually operated valve 232 located on the control panel in the wheel house of the tug. Valve 232 has an inlet line which connects with the pressurized air source. One outlet line 234 of valve 232 connects with motor 119 and through the motor with the pilot port of a normally closed valve 236. When valve 236 is piloted to the open position, it supplies pressurized air to motor 119 to effect extension of ram 38.

Valve 232 has a second outlet line 238 which connects with the other air motor 120 and with the pilot port of a normally closed valve 240. When valve 240 is open, it supplies pressurized air to the motor 120 which is then driven in order to retract the ram 38.

Valve 232 is a three position valve having an off position which disconnects both outlet lines 234 and 238 from the inlet line to the valve. In the extend position of valve 232, line 234 is connected through the valve with the pressurized air source, thereby operating the air extend motor 119. In the retract position of valve 232, outlet line 238 is supplied with pressurized air to drive the air retract motor 120.

The outlet lines 234 and 238 of valve 232 connect with the opposite sides of a shuttle valve 242 having its outlet line connected with one side of another shuttle valve 244 and with the pilot line of a normally open, pilot operated valve 246. The other side of shuttle valve 244 is connected with the pressurized air source through a normally open valve 248 which is controlled by solenoid 188. Valve 248 closes when solenoid 188 is energized.

The outlet side of shuttle valve 244 connects through valve 246 with one side of another shuttle valve 250. The opposite side of valve 250 connects with the pressurized air source through a manually operated valve 252 located on the control panel. Valve 252 is normally closed but can be manually opened. Line 250 has an outlet line 254 which connects with the pneumatic cylinders 248 on the sides of their pistons causing the cylinders to retract when line 254 is pressurized. Line 254 also connects with the pilot line of a pilot operated valve 256 which is normally open but which is piloted to the closed position when line 254 is pressurized. In its open position, valve 256 connects the pneumatic cylinders 148 with the pressurized air source in a manner causing the cylinders to extend, thereby loosening the lock nut 144.

In use, both the port and starboard coupling units are initially in the retracted conditions such that both rams 38 are retracted within the housing 30 as shown in FIG. 4 and the solid line position of FIG. 3. With the coupling units in the retracted condition, the tug 14 is maneuvered into the stern notch 12 until the coupling units are aligned with the channels 18 located on the opposite sides of the notch. At this time, the rams of both coupling units are extended by depressing the extend push buttons.

The port and starboard coupling units respond in identical fashion when their extend push buttons are depressed, so only the operation of the port unit will be described in detail, it being understood that the starboard unit operates in a comparable manner.

When the extend push button 164 is depressed, the 1F relay coil 168 and 2F relay coil 180 are energized. Since the CL1 relay coil is deenergized at this time, the CL1 contacts 182 are in the normally closed condition to complete the circuit to the 2F relay coil 180. The 1F and 2F contacts are both closed to energize both motors 98 and 100 in the extension mode to cause extension of ram 38. Closing of the 2F contacts also energizes the clutch solenoid 186. This opens valve 228 (FIG. 9) which in turn causes valve 230 to open so that air is supplied to engage the low speed clutch 108. The low speed drive motor 98 then operates through the reduction gearing to drive the actuator screw 74 in a low speed, high torque mode.

The low speed, high torque mode is desirable at the outset in order to overcome the inertia of the components. Once the low speed break out forces are no longer required, it is desirable to extend the ram in a high speed, low torque mode. This is accomplished automatically. Once the actuator screw begins turning at a sufficiently high rate of speed, the current sensing relay CL1 is energized to open the CL1 contacts 182. Since the TD1 relay 178 is energized, the TD1 contacts 184 are also open. Consequently, the 2F relay 180 is deenergized, and the low speed motor 98 is deactivated. At the same time, the opening of the 2F contacts deenergizes solenoid 186, closing valves 228 and 230 to disengage clutch 108. The low speed motor is then removed from the drive system by clutch 108 in order to protect it from an overspeed condition. The high speed motor 100 drives the actuator screw 74 in a high speed, low torque mode of operation. By way of example, the low speed motor 98 (15 HP) generates an extending force of 350,000 pounds at an extension rate of 3 inches per minute. The high speed motor 100 (20 HP) generates an extending force of 15,000 pounds at 100 inches per minute extension rate.

When the 1F or 2F contacts, or both, are closed, the R6 relay coil is energized along with solenoid 188. Coil R6 then closes its R6 contacts to energize coil M1 which in turn activates the lubricant pump 142 to supply lubricant to the operating components. The energization of solenoid 188 causes cylinders 148 to loosen the lock nut 144, thus assuring that the lock nut is in a loose condition whenever either motor 98 or 100 is activated. When energized, solenoid 188 closes the normally open solenoid valve 248 (see FIG. 9), thereby disconnecting the air supply from line 254. Valve 256 then reverts to its normally open position in which air is supplied to cylinders 148 in a manner to extend the cylinders. When the cylinders 148 are extended, they turn the lock nut 144 in a direction to thread it away from ring 92, thereby loosening the lock nut and permitting the actuating screw 74 to turn relative to ring 92 so that the ram can extend.

In this manner, the lock nut 144 is loosened and the rotation of the actuator screw 74 causes ring 92 to move outwardly by threaded action, thereby extending the rams and causing their heads to enter the channels 18 on the opposite sides of the stern notch 12 of the barge. As the head 44 on the rams enter channels 18, the teeth 54 on the opposite sides of the heads engage and mate with the teeth 28 on the fore and aft walls of the channels. The ability of the head 44 to pivot in a limited manner about mutually perpendicular axes passing through the balls 46 allows the teeth to properly mate as the heads of the rams are fully extended into the channels. The substantial height of the channels 18 eliminates any need to ballast either the tug or barge and facilitates coupling of the vessels under all draft conditions regardless of the loading of the barge.

When the rams have been fully engaged with the channels, the extend switch of each unit is released to deactivate the drive motors. The tug is then coupled with the barge and can maneuver the barge as desired. The engagement between the teeth 54 and 28 prevents the tug from moving vertically relative to the barge and securely locks the vessels together. Relative roll motion is also prevented, as is heaving to the left or right. The coupling arrangement prevents the tug from moving side to side relative to the barge and avoids any ribbing or other contact. The coupling units permit only relative pitch movement between the vessels about the horizontal axis defined by the aligned rams 38.

As soon as the extend push button 164 is released, solenoid 188 is deenergized, and valve 248 reverts to its normally open position. Then, air is supplied to line 254, causing valve 256 to close and retracting the pneumatic cylinders 148. The cylinders thus tighten lock nut 144 against ring 92. The lock nut prevents the actuating screw 74 from turning relative to ram 38, so that relative pitch motion between the tug and barge does not cause the ram to turn on the screw and possibly retract somewhat. The lock nut provides sufficient torque to overcome the inertia of the drive components when the actuating screw is not heavily loaded, and the operating gears, clutch 108 and the high speed motor 100 can rotate. The lock nut provides a positive mechanical locking arrangement which does not rely on hydraulic force to provide locing power and which is therefore not subject to leakage in pilot check valves or other hydraulic components.

The tug 14 can be uncoupled from barge 10 by retracting the rams. This is accomplished by depressing the retract push button of each coupling unit. Again, both units operate in the same manner in the retract mode. When the retract push button 170 is depressed, the 1R and 2R relay coils are energized, and the 1R and 2R contacts are closed to activate motors 98 and 100 in the retract mode wherein screw 74 is turned in a direction to retract ram 38. Closing of the relay contacts also energizes solenoids 186 and 188 to engage clutch 108 and release the lock nut 144 in the manner indicated previously. When the rams have been fully retracted, the retract button 170 is released to deactivate both drive motors and effect tightening of lock nut 144.

Whenever the ram is extended to its limiting position, switch 192 closes to energize the R1 relay coil. The R1 contacts then open to deenergize the 1F and 2F coils, thereby preventing both drive motors from operating in a direction to further extend the ram. However, the ram can be retracted. Conversely, when the ram is retracted to its limiting position, switch 150 closes to energize the retract limit relay R2. The normally closed R2 contacts then open to deenergize the 1R and 2R coils, thereby preventing either drive motor from operating in the retract mode but permitting extension.

If an overload condition exceeding a preselected limit is sensed by the load cell 138, the overload contacts 176 open to deactivate both drive motors. If the ram is rotated in either direction beyond its limiting position, one of the switches 154 or 156 closes to activate the corresponding indicator light 194 or 196 on the control panel. This provides the captain with a visual indication that the ram is beyond the limiting position. The retract limit indicating light 198 is activated whenever the normally open R2 contacts close in response to the closing of switch 150.

In the event of a power failure or in any other condition causing the electrical drive motors to be disabled, valve 232 can be operated to effect emergency extension or retraction of the rams. When valve 232 is in the extend position, air is supplied to line 234 and through valve 236 to activate the air extend motor 119. Motor 119 turns screw 74 through the gear train in a direction to extend ram 38. Conversely, movement of the valve 232 to the retract position supplies air to line 238 and thereby opens valve 240 to activate the air retract motor 120. The air retract motor then turns screw 74 in a direction to retract the ram 38.

In either the extend or retract position of valve 232, air is supplied to the shuttle valve 242 and through the shuttle valve to the pilot line of valve 246. This causes valve 246 to close and thereby disconnects the pressurized air source from line 254. Valve 256 then reverts to its normally open position, and the pneumatic cylinders 148 are extended to loosen the lock nut 144. In this manner, the lock nut is loosened automatically whenever either of the air motors 119 or 120 is activated.

The ratchet handle 128 is located at an accessible position exteriorly of the housing 30. Consequently, the ratchet handle provides still another backup system for effecting emergency extension or retraction of the ram.

It may be necessary or desirable at times to rotate ram 38 along with the actuating screw 74, such as when the ram is misaligned in one rotative direction or for servicing of the coupling unit. In this situation, the manual valve 252 can be operated to apply air under pressure to line 254 regardless of the condition of valve 246 or 248. Application of air to line 254 causes the tightening of lock nut 144. If the actuating screw 74 is then turned in either the extension or retraction mode, ram 38 turns along with it and does not extend or retract due to the locking action of the lock nut 144. In this fashion, the ram can be rotated for accurate alignment and/or servicing.

To activate the automatic force sensing system, switch 200 is placed in the automatic mode wherein it is in the closed position. Then, the AR relay is energized whenever the differential in the load applied to the port and starboard coupling devices exceeds the level selected by the force selector switch 204. If the starboard unit is loaded disproportionately, the selsyn system shown in FIG. 10 operates on the relative position switch 206 in a manner to activate the port extend relay R4 through the AR relay contacts and switch 206. When the R4 relay coil is energized, the R4 relay contacts close to bypass the extend push button switch 164 and energize the 2F relay coil. This causes the low speed motor to extend the ram of the port coupling unit, and the ram continues to extend until either the relative position switch 206 indicates that it is extended the same distance as the starboard relay or the force selector deenergizes relay AR, indicating that the loading is no longer unequal.

The force sensing system operates in a similar manner to extend the ram of the starboard unit in the event that the port unit is unduly loaded. Thus, the automatic force sensing system continuously monitors the loading on the port and starboard units and assures that each unit is loaded substantially equally and that the rams are extended equally. It should be apparent that the automatic system can be disabled by opening switch 200 and that it can be overridden by depressing the extend or retract push button of either coupling unit. The dial 214 provides a visual indication of the relative positions of the rams, and the indicators of 220 and 222 likewise indicate the distance each ram is extended.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to interpreted as illustrative and not in a limiting sense.

What is claimed is:

1. A ram assembly for installation on a pusher vessel to couple the vessel with a barge when extended into a cavity in a stern notch in the barge, said ram assembly comprising:

a housing rigidly mounted on the pusher vessel;

an extendable and retractable ram mounted in said housing for axial extension and retraction;

a head on the outer end of said ram for entry into the cavity in the stern notch and engagement therein to couple the vessel with the barge when the ram is extended, said ram being rotatable relative to said housing to permit relative pitch movement between the vessel and barge when the ram is extended to engage said head in the cavity;

an actuator screw supported in said housing for rotation and having a threaded connection with said ram to effect extension and retraction of the ram by threading action when said screw is turned in opposite directions;

power means for turning said screw in opposite directions to effect entry of said head into the cavity and withdrawal of said head out of the cavity;

releasable lock means for locking said ram against extension or retraction in a locked condition of the lock means and permitting the ram to extend and retract in a release condition of the lock means;

means for effecting the locked condition of said lock means when said power means is inactive;

means for effecting the release condition of said lock means when said power means is activated to effect turning of said screw; and override means for effecting the locked condition of said lock means regardless of the condition of said power means.

2. The invention of claim 1, wherein said power means includes:

an electric motor having energized and deenergized conditions and extend and retract modes when energized; and means for coupling said electric motor with said screw in a manner to turn the screw in a direction to effect extension of said ram when the motor is energized in the extend mode and in the opposite direction to effect retraction of said ram when the motor is energized in the retract mode.

3. The invention of claim 1, including:

emergency power means independent of said first named power means for turning said screw in opposite directions in an active condition of said emergency means;

means for selectively effecting the active condition of said emergency means; and means for effecting the unlocked condition of said lock means when said emergency means is in its active condition.

4. The invention of claim 1, wherein said power means includes:

a first electric motor having a deenergized condition and an energized condition for turning said screw in a high torque, low speed mode;

means including a clutch for coupling said first motor with said screw, said clutch having an engaged condition wherein said first motor is drivingly coupled with said screw and a release condition wherein said first motor is disconnected from the screw;

a second electric motor having a deenergized condition and an energized condition for turning the screw in a low torque, high speed mode;

means for coupling said second motor with said screw; and means for effecting the release condition of said clutch when the speed at which said screw is turning reaches a predetermined level.

5. The invention of claim 4, including:

a shaft in said coupling means for coupling said first motor with said screw;

emergency pneumatic means connected with said shaft and operable in an active condition to effect turning of said shaft to turn said screw; and means for selectively effecting the active condition of said emergency pneumatic means.

6. Apparatus for coupling a pusher vessel with a barge having a well in the stern thereof, said apparatus comprising:

a pair of vertically elongated channels on opposite sides of the well;

a pair of axially aligned rams on opposite sides of the pusher vessel having horizontal axes, each ram being supported on the vessel for axial extension and retraction;

a head on the outer end of each ram, said head entering the respective channels when the rams are extended;

cooperating means on said heads and channels operable, when said heads are extended into the channels, to couple the pusher craft with the barge in a manner permitting only relative pitch movement therebetween about a horizontal pitch axis extending between said rams;

an actuator screw for each ram supported for rotation and coupled with the corresponding ram in a manner to effect extension and retraction thereof by threading action when the screw is rotated in opposite directions;

power means for each screw for rotating same in opposite directions, each power means being operable independently of the other;

a lock nut threaded onto each actuator screw, each lock nut being adjustable on the screw between a tight condition wherein the nut is tightened against the ram to lock the ram against threaded extension or retraction and a loose condition wherein the nut is displaced from the ram to permit extension and retraction thereof when the screw is turned; and means for effecting the tight condition of each lock nut when the corresponding power means is activated and the loose condition of each lock nut when the corresponding power means is deactivated.

7. The invention of claim 6, including override means for each lock nut for effecting the locked condition thereof regardless of the condition of the corresponding power means.

8. The invention of claim 6, including emergency means for turning each screw in the event of a malfunction of said power means.

9. The invention of claim 8, wherein said emergency means for each screw includes power operated means and manually operated means independent of one another.

10. The invention of claim 6, including:

means for preventing said power means from extending its ram beyond a predetermined limiting position; and means for preventing said power means from retracting its ram beyond another predetermined limiting position.

11. The invention of claim 6, including:

means for monitoring the extension of each ram; and means for controlling said power means in a manner to effect substantially equal extension of each ram.

12. The invention of claim 6, including means for sensing the load applied to each ram and means for deactivating each power means when the load applied to the corresponding ram exceeds a predetermined level.

13. The invention of claim 6, wherein said cooperating means includes:

fore and aft walls on each channel;

a plurality of teeth on each wall, said teeth being spaced substantially uniformly along the height of each wall; and a plurality of teeth on opposite sides of each head for mating with the teeth on both walls of the corresponding channel when the head is extended into the channel.

14. The invention of claim 13, wherein each head includes:

a ball member on the ram;

a rigid head element on said ball member having said teeth on opposite sides thereof, said head element fitting on said ball member in a manner permitting the head element to pivot in limited fashion on the ball member about a horizontal axis oriented substantially perpendicular to the axis of the actuator screw; and a pair of axially aligned pins connecting said head element with said ram for pivotal movement on the ball member about a generally vertical axis, said pins being connected with the head element in a manner permitting same to pivot about said horizontal axis but preventing the head element from turning relative to the ram about the axis of the actuator screw, whereby the pivotal movement of said head element about said horizontal and vertical axes permits the teeth on the head element to mate with the teeth on the walls of the channel.

15. The invention of claim 14, including cooperating surfaces on said ball member and head element which engage to limit pivotal movement of said head element in both directions about said horizontal axis.

16. The invention of claim 6, including:

means for sensing the load applied to each actuator screw; and means for redistributing the loads to effect more equal application of loads to the actuator screws when one screw is loaded more than the other screw by a preselected amount.

17. Apparatus for coupling a pusher vessel with a barge having a well in the stern thereof, said apparatus comprising:

a pair of vertically elongated channels on opposite sides of the well, each channel having fore and aft walls each presenting a plurality of teeth spaced along the height thereof;

a pair of axially aligned rams on opposite sides of the pusher vessel, each ram having a substantially horizontal axis and each ram being supported for axial extension and retraction;

a ball member carried on the outer end of each ram;

a head mounted on each ball member for limited pivotal movement about a pair of mutually perpendicular axes each perpendicular to the axis of the ram and each passing through said ball member, each head having opposite sides for confronting the fore and aft walls of the corresponding channel;

a plurality of teeth on each of the opposite sides of each head at locations to engage and mate with the teeth on said channels when the rams are extended to apply said heads to the channels, whereby the barge and pusher vessel are coupled together in a manner permitting only relative pitch movement therebetween about a horizontal axis defined by the axes of the rams;

means for effecting extension and retraction of said rams to extend the rams into the channels and withdraw the rams from the channels to couple and uncouple the barge and vessel; and a pair of axially aligned pins pivotally mounting each head on the corresponding ball member to establish one of said mutually perpendicular axes, said pins connecting each head with the corresponding ball member in a manner permitting the head to pivot on the ball member about an axis perpendicular to said one axis.

18. The invention of claim 17, wherein said pins connect with said heads in a manner to prevent relative rotation between the heads and ball members about the axes defined by the rams.

19. The invention of claim 18, wherein said means for effecting extension and retraction includes:

an actuator screw for each ram supported for rotation about the axis of the ram;

an internally threaded portion of each ram disposed in threaded engagement with the corresponding screw to extend and retract the ram when the screw is turned in opposite directions; and power means for turning each screw in opposite directions.

20. A ram assembly for installation on a pusher vessel to couple the vessel with a barge when extended into a cavity in a stern notch in the barge, said ram assembly comprising:

a housing adapted for installation on the pusher vessel;

an extendable and retractable ram mounted in said housing for axial extension and retraction;

a head on the outer end of said ram for entry into the cavity in the stern notch and engagement therein to couple the vessel with the barge when the ram is extended;

an actuator screw supported in said housing for rotation and having a threaded connection with said ram to effect extension and retraction of the ram by threading action when said screw is turned in opposite directions;

power means for turning said screw in opposite directions to effect entry of said head into the cavity and withdrawal of said head out of the cavity;

releasable lock means for locking said ram against extension or retraction in a locked condition of the lock means and permitting the ram to extend and retract in a release condition of the lock means;

means for effecting the locked condition of said lock means when said power means is inactive;

means for effecting the release condition of said lock means when said power means is activated to effect turning of said screw; and override means for effecting the locked condition of said lock means regardless of the condition of said power means.

21. A ram assembly for installation on a pusher vessel to couple the vessel with a barge when extended into a cavity in a stern notch in the barge, said ram assembly comprising:

a housing adapted for installation on the pusher vessel;

an extendable and retractable ram mounted in said housing for axial extension and retraction;

a head on the outer end of said ram for entry into the cavity in the stern notch and engagement therein to couple the vessel with the barge when the ram is extended;

an actuator screw supported in said housing for rotation and having a threaded connection with said ram to effect extension and retraction of the ram by threading action when said screw is turned in opposite directions;

power means for turning said screw in opposite directions to effect entry of said head into the cavity and withdrawal of said head out of the cavity;

a lock nut threaded onto said actuator screw, said nut having a tight condition wherein the nut locks said ram against extension and retraction and a loose condition wherein extension and retraction of the ram is permitted in response to rotation of the screw in opposite directions; and means for selectively effecting the tight and loose conditions of said lock nut.

22. A ram assembly for installation on a pusher vessel to couple the vessel with a barge when extended into a cavity in a stern notch in the barge, said ram assembly comprising:

a housing adapted for installation on the pusher vessel;

an extendable and retractable ram mounted in said housing for axial extension and retraction;

a head on the outer end of said ram for entry into the cavity in the stern notch and engagement therein to couple the vessel with the barge when the ram is extended;

an actuator screw supported in said housing for rotation and having a threaded connection with said ram to effect extension and retraction of the ram by threading action when said screw is turned in opposite directions;

a first electric motor having a deenergized condition and an energized condition for turning said screw in a high torque, low speed mode;

means including a clutch for coupling said first motor with said screw, said clutch having an engaged condition wherein said first motor is drivingly coupled with said screw and a release condition wherein said first motor is disconnected from the screw;

a second electric motor having a deenergized condition and an energized condition for turning the screw in a low torque, high speed mode;

means for coupling said second motor with said screw; and means for effecting the release condition of said clutch when the speed at which said screw is turning reaches a predetermined level.

23. Apparatus for coupling a pusher vessel with a barge having a well in the stern thereof, said apparatus comprising:

a pair of vertically elongated channels on opposite sides of the well;

a pair of axially aligned rams on opposite sides of the pusher vessel having horizontal axes, each ram being supported on the vessel for axial extension and retraction;

a head on the outer end of each ram, said heads entering the respective channels when the rams are extended;

cooperating means on said heads and channels operable, when said heads are extended into the channels, to couple the pusher craft with the barge in a manner permitting only relative pitch movement therebetween about a horizontal pitch axis extending between said rams;

an actuator screw for each ram supported for rotation and coupled with the corresponding ram in a manner to effect extension and retraction thereof by threading action when the screw is rotated in opposite directions;

power means for each screw for rotating same in opposite directions, each power means being operable independently of the other;

a lock nut threaded onto each actuator screw, each lock nut being adjustable on the screw between a tight condition wherein the nut is tightened against the ram to lock the ram against threaded extension or retraction and a loose condition wherein the nut is displaced from the ram to permit extension and retraction thereof when the screw is turned; and means for effecting the tight condition of each lock nut when the corresponding power means is activated and the loose condition of each lock nut when the corresponding lock nut is deactivated.

24. Apparatus for coupling a pusher vessel with a barge having a well in the stern thereof, said apparatus comprising:

a pair of vertically elongated channels on opposite sides of the well;

a pair of axially aligned rams on opposite sides of the pusher vessel having horizontal axes, each ram being supported on the vessel for axial extension and retraction;

a head on the outer end of each ram, said heads entering the respective channels when the rams are extended;

cooperating means on said heads and channels operable, when said heads are extended into the channels, to couple the pusher craft with the barge in a manner permitting only relative pitch movement therebetween about a horizontal pitch axis extending between said rams;

an actuator screw for each ram supported for rotation and coupled with the corresponding ram in a manner to effect extension and retraction thereof by threading action when the screw is rotated in opposite directions;

power means for each screw for rotating same in opposite directions, each power means being operable independently of the other; and emergency means for turning each screw in the event of a malfunction of said power means.

25. Apparatus for coupling a pusher vessel with a barge having a well in the stern thereof, said apparatus comprising:

a pair of vertically elongated channels on opposite sides of the well;

a pair of axially aligned rams on opposite sides of the pusher vessel having horizontal axes, each ram being supported on the vessel for axial extension and retraction;

a head on the outer end of each ram, said heads entering the respective channels when the rams are extended;

cooperating means on said heads and channels operable, when said heads are extended into the channels, to couple the pusher craft with the barge in a manner permitting only relative pitch movement therebetween about a horizontal pitch axis extending between said rams;

an actuator screw for each ram supported for rotation and coupled with the corresponding ram in a manner to effect extension and retraction thereof by threading action when the screw is rotated in opposite directions;

power means for each screw for rotating same in opposite directions, each power means being operable independently of the other;

means for preventing said power means from extending its ram beyond a predetermined limiting position; and means for preventing said power means from retracting its ram beyond another predetermined limiting position.

26. Apparatus for coupling a pusher vessel with a barge having a wall in the stern thereof, said apparatus comprising:

a pair of vertically elongated channels on opposite sides of the well;

a pair of axially aligned rams on opposite sides of the pusher vessel having horizontal axes, each ram being supported on the vessel for axial extension and retraction;

a head on the outer end of each ram, said heads entering the respective channels when the rams are extended;

cooperating means on said heads and channels operable, when said heads are extended into the channels, to couple the pusher craft with the barge in a manner permitting only relative pitch movement therebetween about a horizontal pitch axis extending between said rams;

an actuator screw for each ram supported for rotation and coupled with the corresponding ram in a manner to effect extension and retraction thereof by threading action when the screw is rotated in opposite directions;

power means for each screw for rotating same in opposite directions, each power means being operable independently of the other;

means for monitoring the extension of each ram; and means for controlling said power means in a manner to effect substantially equal extension of each ram.

27. Apparatus for coupling a pusher vessel with a barge having a well in the stern thereof, said apparatus comprising:

a pair of vertically elongated channels on opposite sides of the well;

a pair of axially aligned rams on opposite sides of the pusher vessel having horizontal axes, each ram being supported on the vessel for axial extension and retraction;

a head on the outer end of each ram, said heads entering the respective channels when the rams are extended;

cooperating means on said heads and channels operable, when said heads are extended into the channels, to couple the pusher craft with the barge in a manner permitting only relative pitch movement therebetween about a horizontal pitch axis extending between said rams;

an actuator screw for each ram supported for rotation and coupled with the corresponding ram in a manner to effect extension and retraction thereof by threading action when the screw is rotated in opposite directions;

power means for each screw for rotating same in opposite directions, each power means being operable independently of the other;

means for sensing the load applied to each ram; and means for deactivating each power means when the load applied to the corresponding ram exceeds a predetermined level.

28. Apparatus for coupling a pusher vessel with a barge having a well in the stern thereof, said apparatus comprising:

a pair of vertically elongated channels on opposite sides of the well;

a pair of axially aligned rams on opposite sides of the pusher vessel having horizontal axes, each ram being supported on the vessel for axial extension and retraction;

a head on the outer end of each ram, said heads entering the respective channels when the rams are extended;

cooperating means on said heads and channels operable, when said heads are extended into the channels, to couple the pusher craft with the barge in a manner permitting only relative pitch movement therebetween about a horizontal pitch axis extending between said rams;

an actuator screw for each ram supported for rotation and coupled with the corresponding ram in a manner to effect extension and retraction thereof by threading action when the screw is rotated in opposite directions;

power means for each screw for rotating same in opposite directions, each power means being operable independently of the other;

means for sensing the load applied to each actuator screw; and means for redistributing the loads to effect more equal application of loads to the actuator screws when one screw is loaded more than the other screw by a preselected amount.

29. Apparatus for coupling a pusher vessel with a barge having a well in the stern thereof, said apparatus comprising:

a pair of vertically elongated channels on opposite sides of the vessel, each channel having fore and aft walls each presenting a plurality of teeth spaced along the height thereof;

a pair of axially aligned rams on opposite sides of the pusher vessel, each ram having a substantially horizontal axis and each ram being supported for axial extension and retraction;

a ball member carried on the outer end of each ram;

a head mounted on each ball member for limited pivotal movement about a pair of mutually perpendicular axes each perpendicular to the axis of the ram and each passing through said ball member;

a plurality of teeth on opposite sides of each head at locations to engage and mate with the teeth on said channels when the rams are extended to apply said heads to the channels, whereby the barge and pusher vessel are coupled together in a manner permitting only relative pitch movement therebetween about a horizontal axis defined by the axes of the rams;

means for effecting extension and retraction of said rams to extend the rams into the channels and withdraw the rams from the channels to couple and uncouple the barge and vessel; and a pair of axially aligned pins pivotally mounting each head on the corresponding ball member to establish one of said mutually perpendicular axes, said pins connecting each head with the corresponding ball member in a manner permitting the head to pivot on the ball member about an axis perpendicular to said one axis.

* * * * *